US006481988B2

(12) United States Patent
Valentinovich

(10) Patent No.: US 6,481,988 B2
(45) Date of Patent: Nov. 19, 2002

(54) INTERNAL COMBUSTION ENGINE

(75) Inventor: Vorobyov Yuri Valentinovich, Tambov (RU)

(73) Assignee: Otice Establishment, Vaduz (LI)

( * ) Notice: Subject to any disclaimer, the term of this patent is extended or adjusted under 35 U.S.C. 154(b) by 0 days.

(21) Appl. No.: 09/817,693

(22) Filed: Mar. 26, 2001

(65) Prior Publication Data

US 2001/0046447 A1 Nov. 29, 2001

(30) Foreign Application Priority Data

Mar. 31, 2000 (EP) ..... 00 106 891.5

(51) Int. Cl.[7] ..... F01C 1/02
(52) U.S. Cl. ..... 418/61.1; 418/138; 418/139
(58) Field of Search ..... 418/61.1, 138, 418/139

(56) References Cited

U.S. PATENT DOCUMENTS

| | | | | | |
|---|---|---|---|---|---|
| 822,700 | A | * | 6/1906 | Steele | 418/61.1 |
| 1,350,159 | A | * | 8/1920 | Johnson | 418/61.1 |
| 1,935,096 | A | * | 11/1933 | Muller | 418/61.1 |
| 1,961,592 | A | * | 6/1934 | Muller | 418/61.1 |
| 2,423,507 | A | * | 7/1947 | Lawton | 418/61.1 |
| 2,859,911 | A | * | 11/1958 | Reiter | 418/61.1 |
| 3,259,306 | A | * | 7/1966 | Porteous | 418/61.1 |
| 3,703,344 | A | | 11/1972 | Reitter | |
| 3,919,980 | A | * | 11/1975 | Veatch | 418/61.1 |

FOREIGN PATENT DOCUMENTS

| | | |
|---|---|---|
| DE | 2825071 | 12/1979 |
| EP | 0601218 | 6/1994 |
| WO | WO9901666 | 1/1999 |

* cited by examiner

*Primary Examiner*—Thomas Denion
*Assistant Examiner*—Theresa Trieu
(74) *Attorney, Agent, or Firm*—Cooper & Dunham LLP; Donald S. Dowden

(57) ABSTRACT

First pivot bodies are received for rotation in first recesses in the housing member. A piston member is mounted in a eccentric portion of the drive shaft such to orbit in operation. Second pivot bodies are received for rotation in second recesses in the piston member. Dividing vanes are inserted at their ends in slots, formed in the first and second pivot bodies in a free floating manner such to reciprocate in operation of the engine. These vanes define a number of combustion chambers. The ends of the vanes received in the first pivot bodies of the housing member perform pivoting movements and the ends received in the second pivot bodies of the piston members perform orbiting movements. Thus, only small frictions and wear at the vanes in and the pivot bodies occur and the engine can be designed with small dimensions.

1 Claim, 11 Drawing Sheets

INTERNAL COMBUSTION ENGINE

CROSS REFERENCE TO RELATED APPLICATIONS

This specification is based on the European application No. 00 106 891.5 forming the priority application.

BACKGROUND OF THE INVENTION

1. Field of the Invention

The present invention relates to an internal combustion engine having a housing member which is closed at opposite ends by cover plates; having a drive shaft extending through said housing member perpendicularly to the cover plates; further having a piston member located inside the housing member and eccentrically supported on a eccentric portion of the drive shaft and guided to orbit without rotation when the combustion engine is in operation; further having a plurality of radially and equidistantly arranged vanes sealed against the cover plates, the housing member and the piston member.

2. Description of the Related Art

Internal combustion engines which do not comprise pistons which perform rectilinear stroke movements and comprise rather pistons which perform rotary movements or orbital movements incorporate considerable advantages over engines with rectilineary moving pistons.

Such advantages are small overall measurements, low weight and a rapid response regarding power changes. The reason thereto is that the pistons of such combustion engines are designed as rotors which are directly mounted on the drive shaft and perform a uniform rotating or orbiting, resp. movement, not subject to accelerations and decelerations and which are not subjected to inertias, unlike the pistons of conventional internal combustion engines. Also, since the combustion chambers of such combustion engines are located generally at a center area of the engine and in case of engines having orbiting movements of their pistons, specifically in a point-symmetrical arrangement relative to the drive shaft, the dynamic characteristics of the overall engine is not affected by the moving pistons.

An important feature of internal combustion engines of which the rotor performs a continuous, uniform orbiting movement around the drive shaft lies in the fact that the engine includes a plurality of separate combustion chambers, each providing favorable conditions for the combustion.

The main structural elements of combustion engines with an orbiting piston are the engine housing (or case, resp.) in the shape roughly of a flat box, which is closed at its top and at its bottom by cover plates, a drive shaft extending perpendicularly to the cover plates, which drive shaft has an eccentric portion, corresponding to the crankshaft of conventional internal combustion engines. A rotor operating as the piston member is mounted in the engine housing onto the eccentric section of the drive shaft. A number of blades or vanes, resp. which are sealed against the top cover plate and bottom cover plate extend between the rotor and the engine housing and are connected in such a manner to the rotor and to the engine housing that they can perform pivoting movements when the engine is in operation. These blades or vanes, resp. are, thus, arranged roughly in a star-like arrangement around the rotor and define the various combustion chambers.

The side surface portions of the rotor facing the combustion chambers may have additional depressions and/or projections, ledges for providing an improved lending or mixing, resp. of the fuel and air during the intake stroke phase, and may additionally be shaped that a layer-by-layer combustion of the fuel/air mixture occurs upon the ignition such that a high economic operation of the engine is arrived at.

The sealing members which are located between the orbiting rotor and the top and bottom cover plates are ordinary sealing strips or sealing rings which are spring biassed against the corresponding surfaces.

A well known internal combustion engine having a rotating rotor is the design of Wankel. A drawback of this Wankel engines are the rather elongate, stretched combustion chambers causing a inferior combustion of the air-fuel mixture causing a high fuel consumption. Furthermore, the inner side walls of the housing have a trochoidal from. The rotor is provided with sealing strips which wipe over these inner trochoidal side walls. This leads to serious vibrations of the sealing strips and to a high wear due to the continuous changing of the contour of the surface of these inner side walls. Also, the trochoidal surfaces lead to an uneven heating thereof, such that the combustion chamber shifts relative to the housing so that thermal tensions are produced which, among others, distort the trochoidal surface of the inner side walls of the housing of the engine.

A number of publications disclose internal combustion engines in which the piston does not make a simple rotary movement, but rather an orbiting movement around the center axis of the drive shaft. Such engines are disclosed e.g. in the specification of the U.S. Pat. No. 3,703,344 to Ritter and the French Patent specifications FR 2,180,346 and FR 1,366,410.

In these and other known engines the orbital motion of the piston member is generally achieved in that three additional eccentrical units are mounted at both sides of the piston member which eccentrical units feature an eccentricity of the main eccentric portion of the drive shaft. Furthermore, additional eccentric units are located in recessed areas in the cover plates and side surfaces of the orbiting piston. These designs do, however, not allow the small rotating motions of the piston member relative to the drive shaft which occur during its orbiting movement. Moreover, these known designs necessitate relatively large overall dimensions of the engine, a relatively high weight of the piston member and specifically a highly complex lubricating system.

Also to be mentioned is the U.S. Pat. No. 3,787,150 of Sarich. The vanes or blades, resp. of the Sarich engine are guided at one end in the engine housing in such a manner, that they perform analogue to sliders a rectilinear movement when the piston member performs its orbiting motions. The opposite ends of the vanes are received in tangentially extending slots in the orbiting piston. However, this design necessitates quite complicated mounting and sealing structures especially at the piston, and specifically the mounting structures in the piston are subject to considerable wear.

BRIEF SUMMARY OF THE INVENTION

An object of the present invention is to provide a internal combustion engine with a piston member supported to perform an orbiting movement in which the vanes are supported and guided in a manner which gives rise to a minimum of friction and wear, which allows small overall dimensions and a simple lubrication system.

A further object is to provide an internal combustion engine with a piston member supported to perform an orbiting movement which includes a plurality of first equidistant cylinder shaped pivot bodies, each received for rotation in a corresponding first recess formed in its housing member and having a slot extending in the direction of its generatrix, in which slot a first end section of a corresponding vane is received for a free reciprocating sliding movement therein; and including a plurality of second equidistant cylinder shaped pivot bodies, each received for rotation in a corresponding second recess formed in mentioned piston member and having a slot extending in the direction of its generatrix, in which slot a second end section of a corresponding vane is received for a free reciprocating sliding movement therein; whereby in operation of the internal combustion engine each vane is free to perform reciprocating and pivoting movements to induce the orbital motion of the piston member relative to the housing member.

Since the width of such an engine is determined by the eccentricity of the piston member supported on the eccentric portion of the drive shaft, specifically by the radius of the eccentric portion, thus the size of the bearing between the piston member and the eccentric portion, by the dimensions of the needed oil wiping structures which are mounted in the piston member and specifically by the overall mechanism, i.e. structures which in operation produce the orbital motion of the piston member, the engine in accordance with the present invention has the advantage, that the vanes which divide the space between the piston member and the housing member into individual combustion chambers are pivotally mounted by pivot bodies to the piston member and by further pivot bodies to the housing member, whereby the dimensions of the combustion engine are determined by the minimal possible distance between the pivot axes of mentioned pivot bodies, thus the overall dimensions of the engine can be kept small. Furthermore, since the vanes are received for a free reciprocating movement in the slots of the pivot bodies, the wear can be kept at a low value. A impacting of the vanes at the respective end positions of their reciprocating movements in the slots may thus be avoided by mechanically acting springs and/or a fluid damping arrangement.

The axial length of the first pivot bodies which are mounted in the housing member may, according to a further embodiment, exceed the overall thickness of the housing member and may be supported for rotation in the cover plates of the engine.

Likewise, the axial length of the second pivot bodies which are mounted in piston member may also exceed the overall thickness of the piston member and may be supported for rotation in rotating disks in the cover plates, in which case the piston members are eccentrically supported in these disks with an eccentricity which equals the eccentricity of the piston member.

A further advantage of the vanes being mounted in pivot bodies is that the acceleration of the center of gravity of the vanes can be equalized and that, furthermore, the transmission of the inertia of the vanes to the housing member during the compression stroke and to the rotor during the combustion stroke allows to use the inertia of the blades as the driving force. This allows a decrease of the overall dimensions of the combustion engine, to simplify its construction, to decrease the friction and, thus, simplify the lubrication system.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawing, wherein.

DETAILED DESCRIPTION OF THE INVENTION

Figure 1:
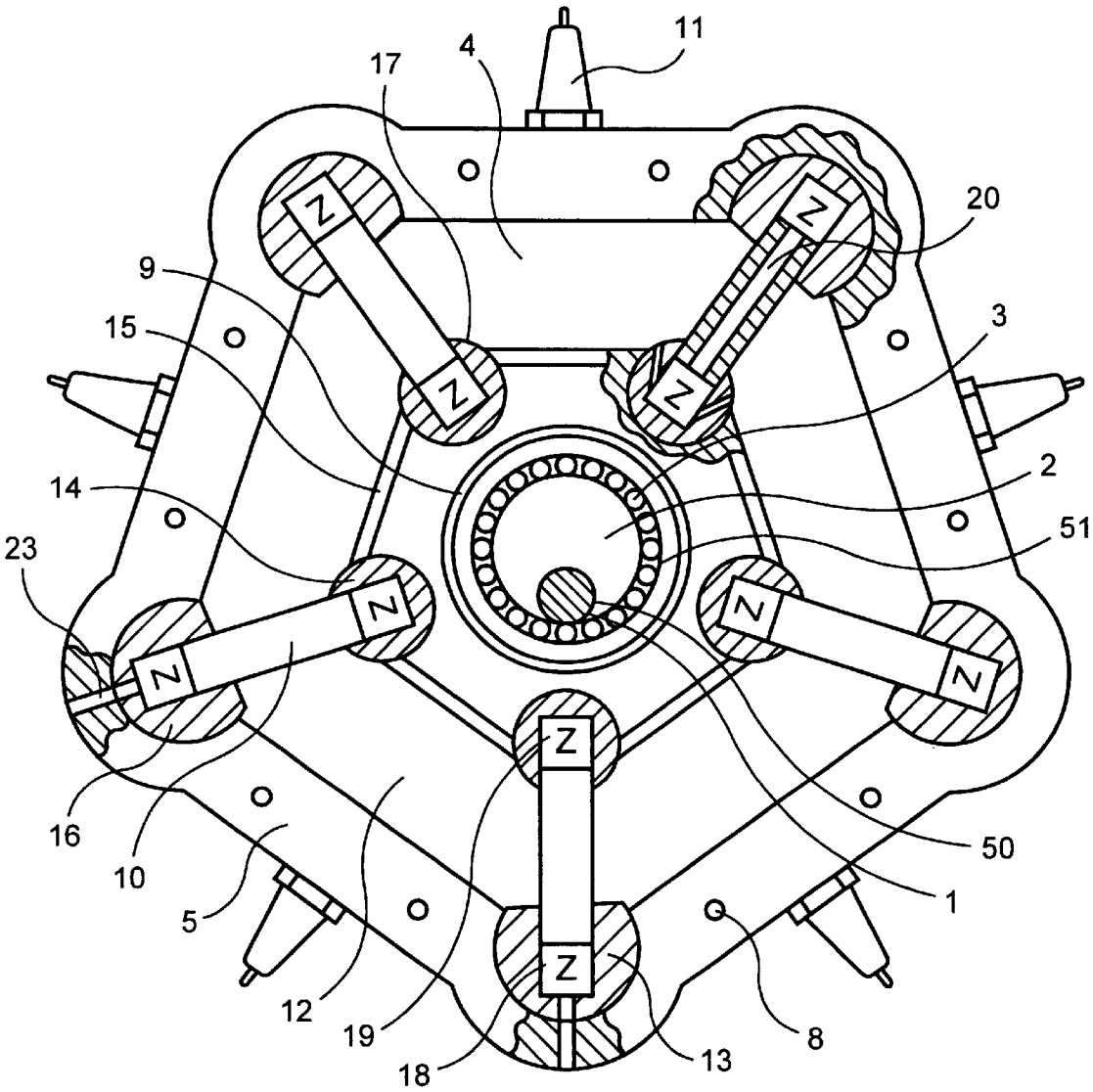
FIG. 1 is a schematic view of a cross-section of the internal combustion engine illustrating its basic design.

The internal combustion engine as illustrated in FIG. 1 has a drive shaft 1 with an eccentric portion 2. This eccentric portion 2 may be an integral part of the drive shaft 1 or a separate body firmly mounted on the drive shaft 1 by any known technique. The distance between the center axis 50 of the drive shaft 1 and the center axis 51 of the eccentric portion 2 determines the eccentricity and is regarding the operation analogue to the crankshaft radius of conventional piston engines.

Figure 12:
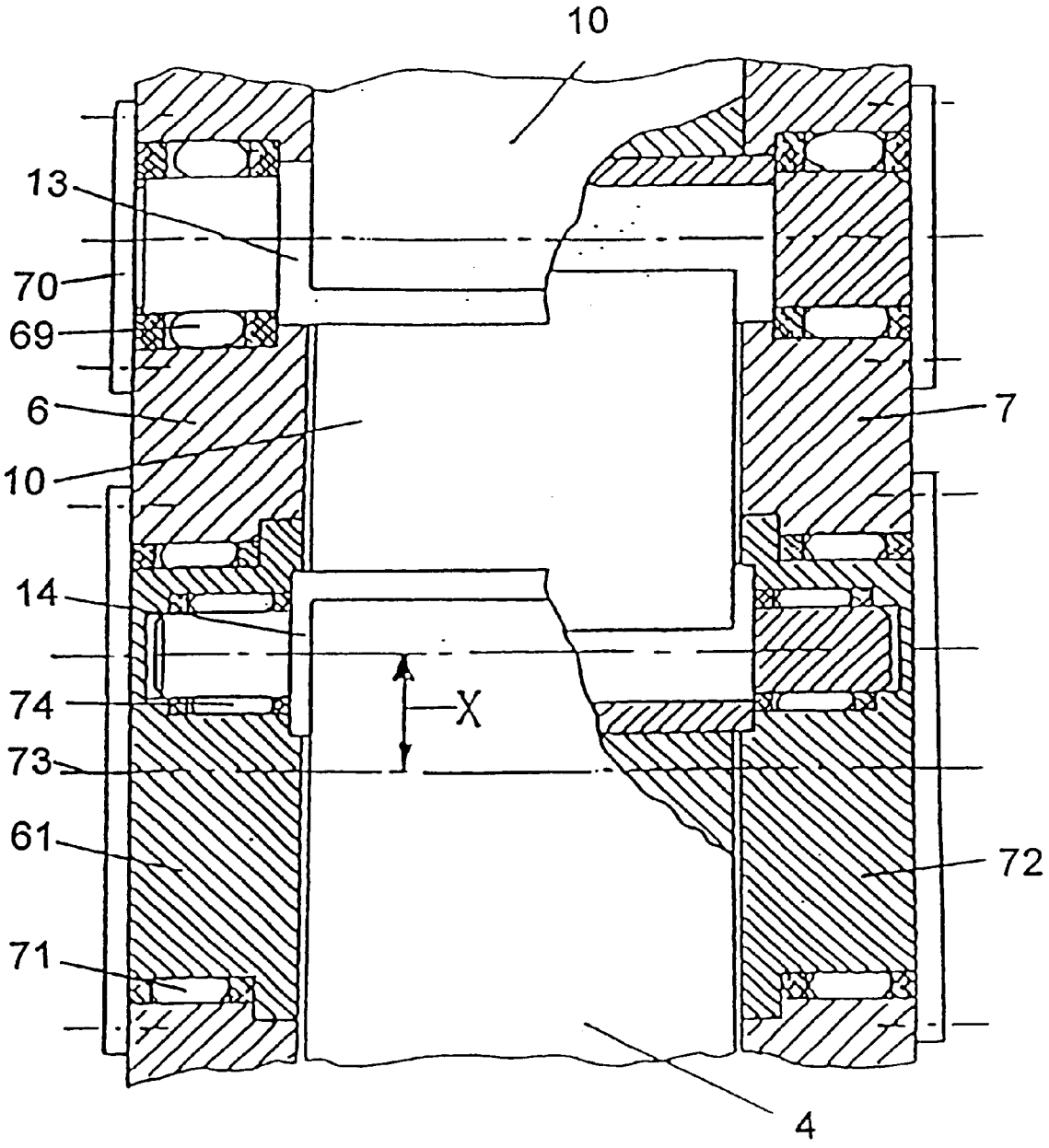
FIG. 12 is a sectional view of a vane and its two pivot bodies as supported for rotation in the cover plates.
Figure 13:
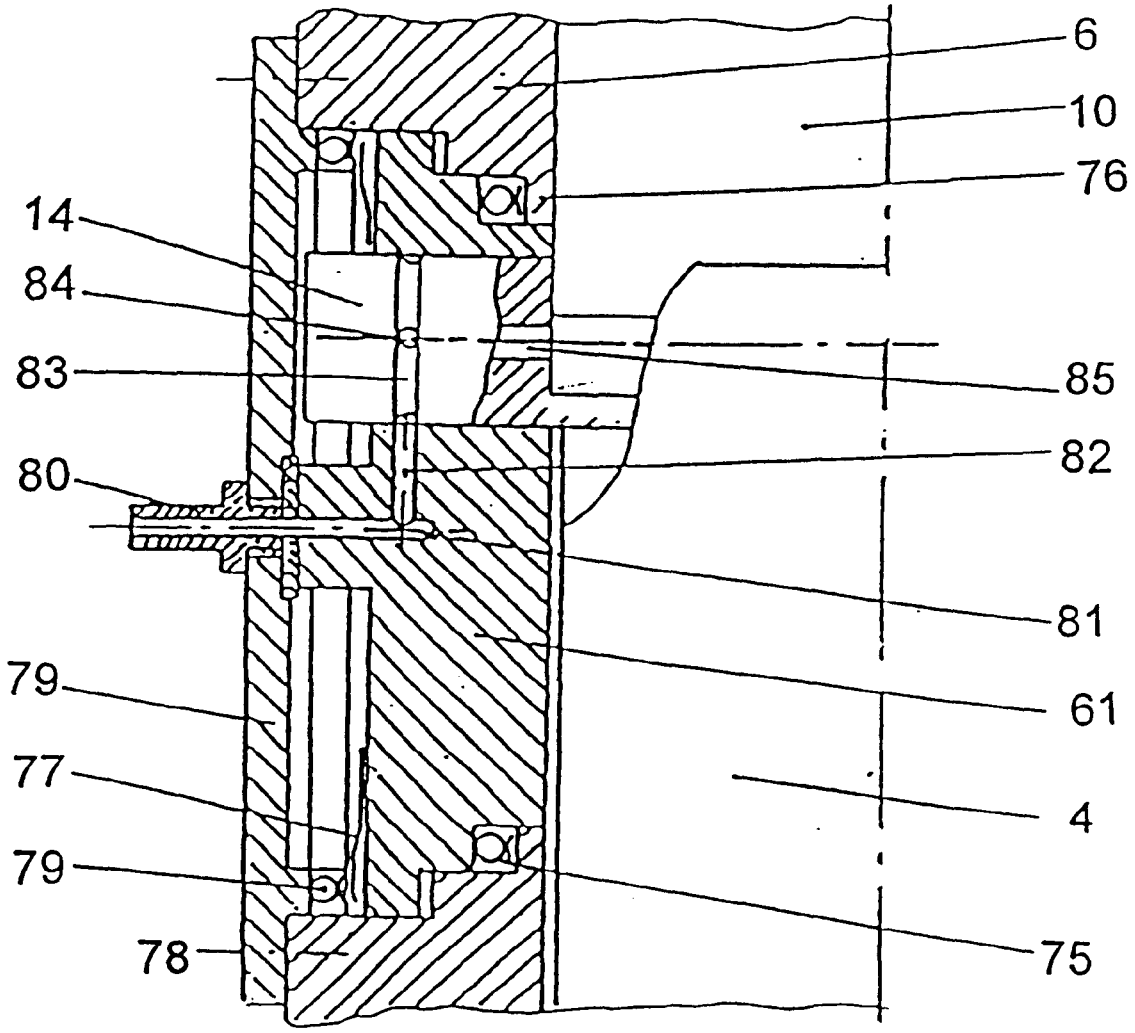
FIG. 13 illustrates the support of the vanes, which support generates the orbiting movement of the piston member.

An orbiting piston member 4 is mounted via a bearing 3 on the eccentric portion 2. This piston member 4 is arranged inside of a housing member 5 and at a distance therefrom. The housing member 5 is covered at one side by a first end cap 6 and at the opposite side by a second end cap 7, such as shown in FIGS. 12 and 13. The reference numeral 8 depicts holes in the housing member 5 for the receipt of bolts by means of which the end caps 6 and 7 are mounted onto the housing member 5. Thus, the housing member 5 and the two end caps 6 and 7 enclose the space in which the eccentrically supported piston member 4 is located and performs its orbital movements. Ring-shaped sealing strips 9 (of which only one is shown) are located in corresponding grooves in the piston member 4, which sealing strips 9 are biassed in a generally known manner against the end caps 6 and 7 by biassing springs arranged in the grooves of the piston member 4. There may be a plurality of sealing strips 9 on each side of the piston member 4, of which a number can operate as oil-wiping strips and a further number as sealing strips.

The space between the piston member 4 and the housing member 5 is divided by a plurality of vanes 10 into a plurality of combustion chambers. The reference numeral 11 denotes the spark plugs needed for each combustion chamber 12. The air/fuel mixture intake and gas exhaust channels including the respective valves are not particularly illustrated because they are well known in the art.

The vanes 10 project at their first end into first equidistant cylinder-shaped pivot bodies 13 of which each is received for rotation in the housing member 5, and project at their second, opposite end into second equidistant cylinder-shaped pivot bodies 14 received for rotation in the piston member 4, as will be described further below.

The piston member 4 includes further sealing strips 15 extending along its circumference, which sealing strips 15 contact at their longitudinal edges the end caps 6 and 7 and at both of their ends the second pivot bodies 14 located in the piston member 4. These sealing strips are urged against the surfaces against which they are to seal by biassing springs and also by gas pressure in a manner known to the person skilled in the art.

The first pivot bodies 13 are received for rotation in correspondingly shaped first recesses 16 formed in the housing member 5. The sector angle of these recesses 16 is larger than 180°. The center axes of the pivot bodies 13, 14 extend parallel to the center axis 50 of the drive shaft 1.

The second pivot bodies 14 are received for rotation in correspondingly shaped second recesses 17 formed in the piston member 4. The sector angle of these recesses 17 is also larger than 1800 so that the pivot bodies 14 are safely kept in the piston member 4.

All pivot bodies 13, 14 include a slot 18 and 19, resp. extending in the direction of the generatrix. The width of the slots 18 and 19 is a little larger than the thickness of the vanes 10. The vanes 10 are received at their two ends in the slots 18 and 19 and, therefore, are held for a free reciprocating movement in the corresponding pivot bodies 13, 14.

The slots 18 and 19 can be interconnected by channels 20 extending through the vanes 10.

Since the pivot bodies 13, 14 can rotate in their respective recesses 16, 17 the vanes 10 can perform freely reciprocating and pivoting movements following the orbital movement of the piston member 4.

FIG. 1 shows five vanes 10 arranged in a star-like fashion. Quite obviously, the number of vanes 10 can be selected to be differently. The axial length of the cylinder-shaped pivot bodies 13, 14 can correspond to the height of the combustion chambers 12 or the piston member 4, respectively, such that the pivot bodies 13, 14 are guided and held in the recesses 16, 17. Alternatively, this axial length may exceed the height of the combustion chambers 12 and in such case they may be supported for rotation in the end caps 6, 7, as will be explained more in detail further below.

Figure 4:
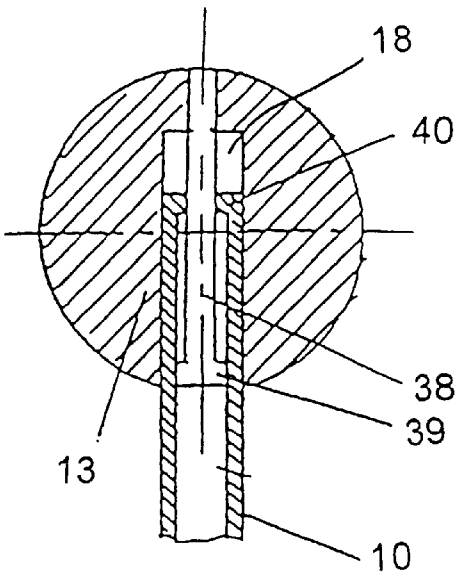
FIG. 4 illustrates a further possible design for retaining the vanes in the slots of the pivot bodies.
Figure 3:
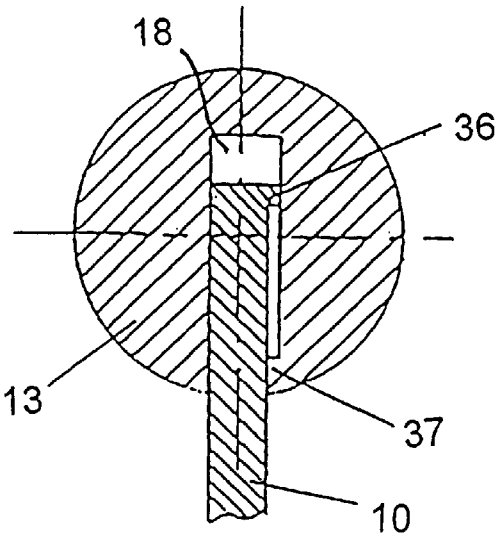
FIG. 3 illustrates a second design of means for retaining the vanes in the slots of the pivot body.
Figure 2:
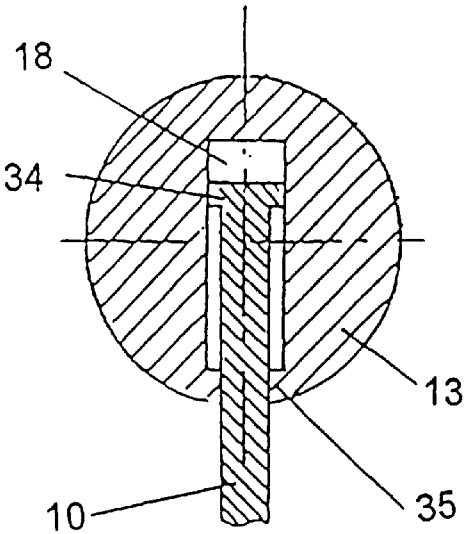
FIG. 2 illustrates a first design of means for retaining the vanes in the slots of the pivot body.

Reference is now made to FIGS. 2–4.

Measures are taken in order to prevent the vanes 10 from slipping out of the slots 18, 19, for instance during the assembling of the engine. According to FIG. 2, the vanes 10 are provided at their ends with a two-way projection 34. The slots 18 are provided at their free end with a projecting abutment member 35 (which must not be a complete inner ring but may include a number of individual projections). Thus the vane 10 cannot slip out of the slot 18.

A further embodiment is illustrated in FIG. 3. Here the vane 10 includes one single projection 36 and only one single projection 37 is present in the slot 18.

According to the embodiment of FIG. 4, a rod 38 is held in the pivot body 13, 14, which rod 38 has an annular abutment member 39 at its free end. The vane 10 has an annular projection 40 along the inner circumference, such that again the vane 10 is held captive in the slot 18.

Figure 5:
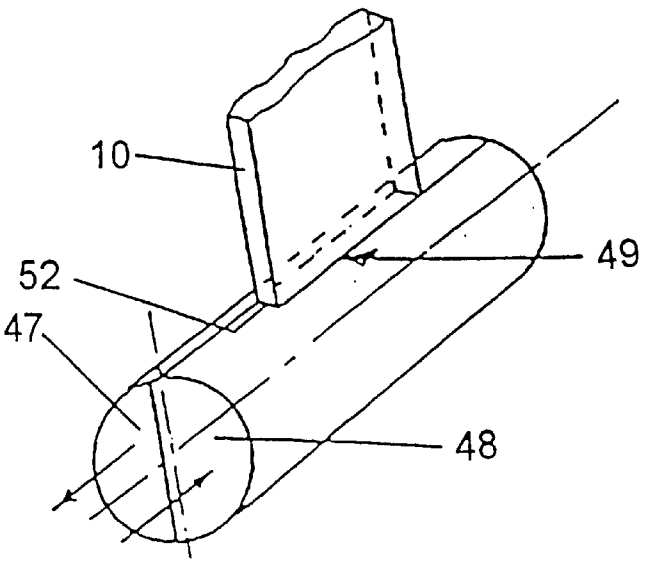
FIG. 5 is a view of a pivot body consisting of two parts.

According to the embodiment of FIG. 5, the pivot bodies are comprised of two identical elongate pivot body halves 47 and 48. Each pivot body half has a stepped surface portion having a height 52 which equals the thickness of the vanes 10. Thus, when the two halves 47, 48 are brought together, the stepped surface portions define together the slots 18 and 19, resp. for the receipt of a vane 10. Since these two pivot body halves 47 and 48 may be moved in their axial position relative to 30 each other, the length of the slots 18 and 19, resp. in which the vane 10 is received can be changed to allow e.g. for manufacturing tolerances.

Figure 6:
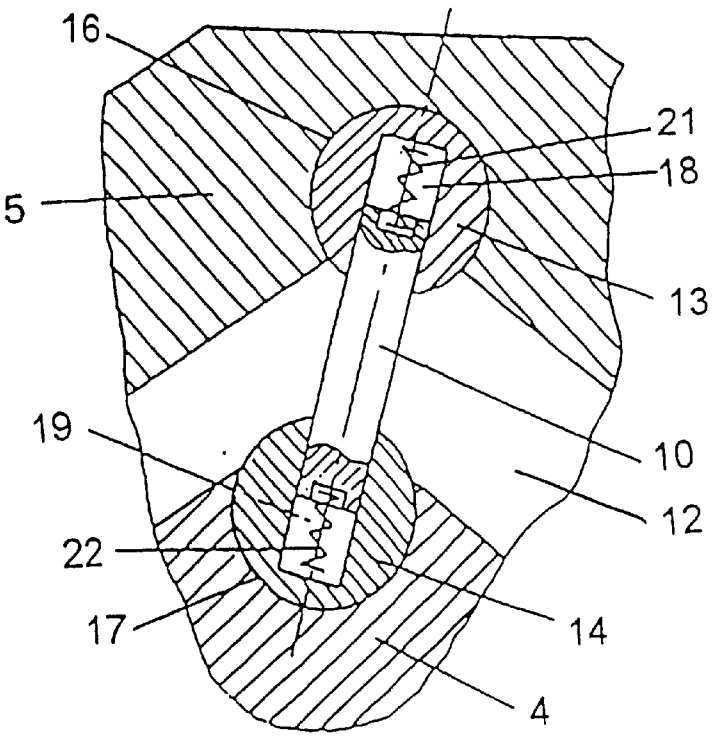
FIG. 6 illustrates a vane inserted in the slots of its two pivot bodies and the damper spring members.

The length of the vanes 10 is less than the distance between the bottom of the slots 18, 19 such that at no position of the vanes 10 a clamping thereof between the slots 18, 19 of the pivot bodies 13, 14 is possible. According to the embodiment illustrated in FIG. 6 springs 21, 22 are placed in the slots 18, 19 to act between the ends of the vanes 10 and the bottom of the slots. These springs 21, 22 act as damper members to attenuate the longitudinal reciprocating movements of the vanes 10. These springs 21, 22 may be spiral springs, leaf springs, elastic plates or may have any suitable shape or constitution.

The arrangement is, thereby, selected in such a manner that the vanes 10 are supported in the middle position relative to the centres of rotation of the pivot bodies 13 and 14.

Figure 8:
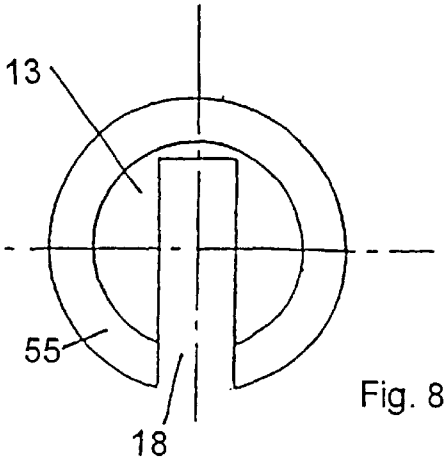
FIG. 8 illustrates a top view of the pivot body of FIG. 7.
Figure 7:
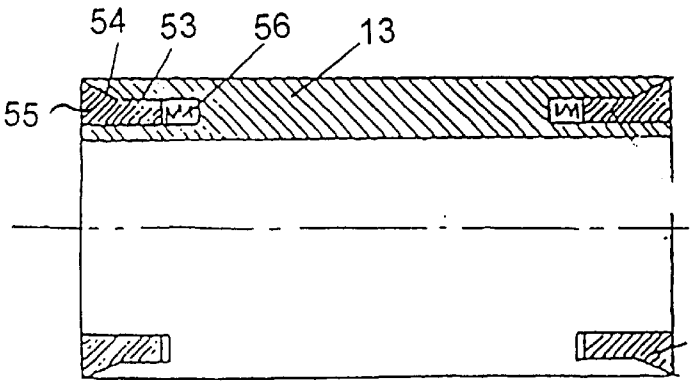
FIG. 7 illustrates a section through a pivot body received in the housing member with its sealing structure.

FIGS. 7 and 8 illustrate an embodiment of a first pivot body 13, that is a pivot body located in a recess 17 of the housing member 5, in which the axial length of this pivot body 13 equals the height of the combustion chambers 12, i.e. the thickness of the housing member 5, such that the ends of the pivot body 13 are to be sealed against the cover plates 6 and 7.

A recess 53 in the form of a split circular ring (the split due to the slots 18, 19) is arranged in both end surfaces of the pivot body 13. The inner circumferential wall of the recesses 53 adjacent the outer side of the pivot body and located at the ends of the pivot body 13 has a wall section 54 which extends at an oblique angle relative to the center axis of the pivot body 13 such as can be clearly seen in FIG. 7. A correspondingly shaped sealing ring 55 is disposed in this recess 53. This sealing ring 55 is biassed by a spring 56 towards the outside, that is when assembled onto a respective cover plate 6 and 7, respectively, to ensure a proper sealing along the upper and lower ends of the pivot bodies 13.

Figure 10:
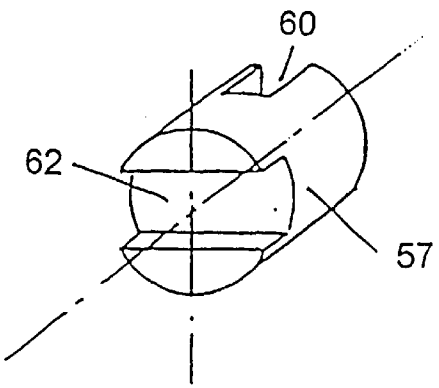
FIG. 10 is a view of the compensating body illustrated in FIG. 9.
Figure 9:
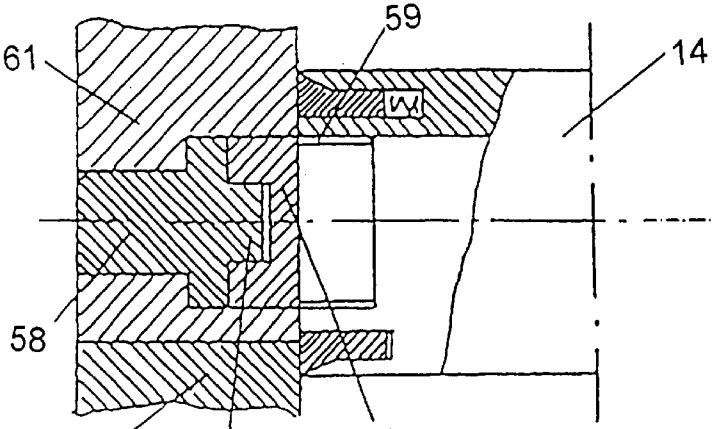
FIG. 9 is a section through a pivot body received in the piston member and supported in the cover plates.

A sealing and mounting arrangement of the second pivot bodies 14 of this embodiment, i.e. in which the axial length also of the second pivot bodies 14 equals the height of the combustion chamber 12, is illustrated in FIGS. 9 and 10. The second pivot bodies 14 are located in the piston member 4. At least one end of these pivot bodies is provided with compensating members 57 and 58.

The pivot body 14 has at the one end a cylinder-shaped recess 59. The outer diameter of the first compensating member 57 is less than the inner diameter of the recess 59 such that the compensating member 57 received in the recess 59 can freely rotate therein. This compensating member 57 includes at its end received in mentioned recess a slot 60 having a width which equals the width of the slot 18 of the pivot body 14. Thus, this slot 60 completes the slot 18.

Reference numeral 61 denotes a circular plate which is supported for rotation in the end cap 6 and which will be described in detail later on by reference to FIGS. 12 and 13. The second compensating member 58 is mounted in the circular plate 61.

The first compensating member 57 includes at its end facing the second compensating member 58 a second slot 62 extending perpendicularly to the first named slot 60. The second compensating member 58 includes at its end facing the first compensating member 57 a diametrically extending cam-like projection 63 which is received in the slot 62. These compensating members 57 and 58, specifically the first compensating member 57 allows the pivot body 14 to perform small insignificant displacing movements in mutually perpendicular directions such to compensate possible inaccuracies of the manufacture and possibly assembling of the part in question.

Figure 11:
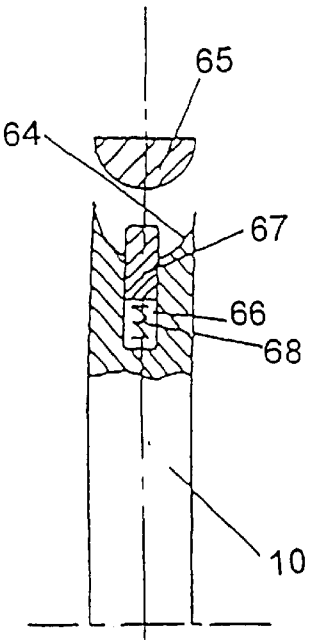
FIG. 11 is a sectional view of a length adjustable vane.

FIG. 11 illustrates a vane 10, and specifically a measure to overcome possible clearances between the longitudinal edges of the vane 10 and the oppositely located end caps 6 and 7. Basically, only one of the two longitudinal edges of a vane 10 must include the corresponding structure.

A semi-circular groove 64 is formed along the longitudinal edge in question. A sealing strip 65 of a semi-circular cross-section is received in the groove 64. An elongate recess 66 is arranged at the bottom of the groove 64 and a sealing strip pressing member 67 is received in the elongate recess 66, which pressing member 67 is biassed by a spring 68 against the pressing member 67 which in turn biases the sealing strip 65 against the end cap 6.

When the axial lengths of the pivot bodies 13, 14, equals the height of the combustion chambers 12, i.e. the height of the piston member 4 and the housing member 10, respectively, the pivot bodies are guided and supported in the recesses 16 and 17.

It may, however, be desirable to guide and support the pivot bodies 13, 14 in the end caps 6 and 7, in which case the length of the pivot bodies exceeds the height dimensions mentioned above. Such an arrangement increases the reliability of the support and guiding of the pivot bodies 13, 14 and allows, furthermore, smaller distances between their center axes such that the dimensions of the engine may be selected to be smaller.

Such an embodiment is illustrated to FIGS. 12 and 13.

In FIG. 12 there is shown a part of the piston member 4 in which a second pivot body 14 is received in a recess as explained earlier.

The part of the housing member 5 located opposite the piston member 4 harbours a first pivot body 13.

A vane 10 extends between the first and second pivot bodies 13, 14 and is received in their corresponding slots 18, 19.

In operation the first pivot body 13 makes merely restricted rotational movements to and fro during the pivotal movements of the vane 10. Thus, the first pivot body is supported and guided by a conventional roller bearing 69 in the cover plate 6. Reference numeral 70 denotes a protecting cover or top of the roller bearing 69.

The second pivot bodies 14 perform, however, in operation an orbital movement in accordance with the orbital movement of the piston member 4.

Thus, a circular plate 61 is supported for rotation via roller bearings 71 in the end cap 6, and correspondingly, a further circular plate 72 is present in the opposite end cap 7. The second pivot bodies 14 are supported at a distance X from the axis of rotation 73 via roller bearings 74 in the rotating circular plates 16 and 72, which distance X equals the eccentricity of the eccentric portion 2 of the drive shaft 1.

In order to feed a lubrication medium to the second pivot bodies 14, which are to perform an orbital motion, an arrangement according to FIG. 13 is used.

FIG. 13 illustrates a second pivot body 14 in which an end of a vane 10 is received. The pivot body 14 is inserted in the piston member 4. The pivot body 14 is inserted in the described eccentric state as explained above in the circular plate 61. The circular plate 61 is supported via a thrust bearing 75 on a shoulder portion 76 of the end cap 6. At its opposite side the circular plate 61 is supported via a spring member 77 and a further thrust bearing 78 against a bearing cover 79 which is firmly mounted e.g. by screw bolts to the end cap 6.

Accordingly, the circular plate 61 with the eccentrically supported pivot body 14 can freely rotate in the end cap 6.

A connecting stub 80, which is adapted for a connecting to a lubricant feeding line, communicates flow-wise with a channel 81 extending into the circular plate 61. This channel 81 is followed by a further channel 82. A ring-shaped groove 83 is performed along the circumference of the pivot body 14. A number of radially extending further channels 84 connect this groove 83 to a channel 85 extending in the axial direction of the pivot body 14. This described channel arrangement allows the flow of the lubricant to the various surfaces of the recesses and pivot bodies held therein and the respective contacting surfaces of the circular plate 61 and end cap 6. It is to be noted, furthermore, that the lubricant flows through the axial channel 85 towards the opposite end of the pivot body 14 located at the opposite end cap 7.

Embodiments of a dampening the reciprocating movements by gas pressure will now be described with reference to FIGS. 14–17.

Figure 14:
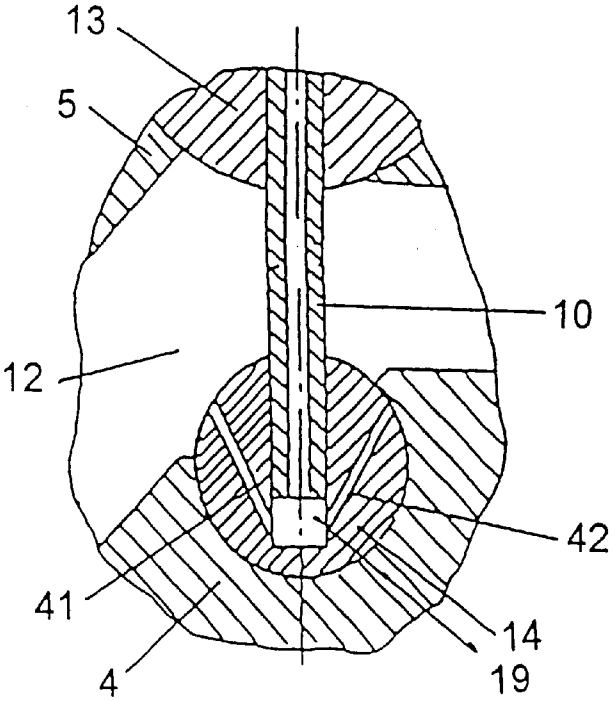
FIG. 14 illustrates a gas channel arrangement for a supporting of the vanes in the slots by gas pressure.

As shown in FIG. 14, the pivot body 14 of this embodiment includes gas channels 41, 42 arranged in a V-shaped configuration extending from the slot 19 towards the combustion chamber 12. As can be seen, a communication between the slot 19 and the respective combustion chamber 12 is possible only in certain rotational positions of the pivot body 14. The combustion gases, which can enter into the slots 19 when the channels 41, 42 allow a communication between the respective combustion chamber 12 and the respective slots 19, will keep the vanes 10 centered, i.e. in a middle position relative to the pivot bodies 13 and 14.

Figure 15A:
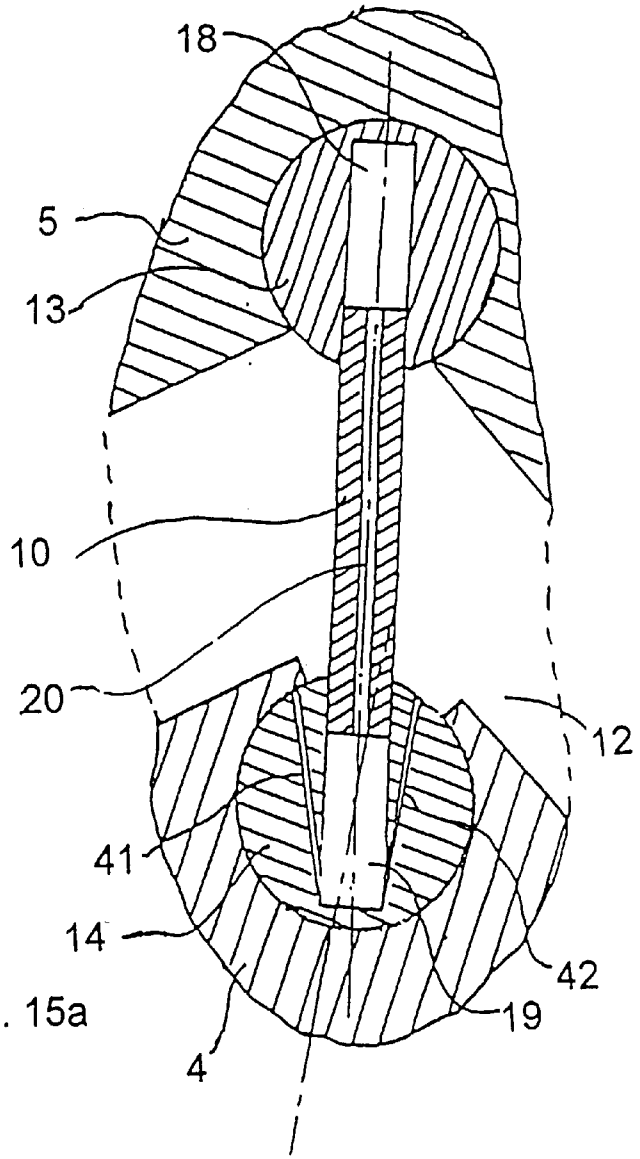
FIGS. 15*a–c* illustrate various positions of the gas channels during operation of a first embodiment.
Figure 15C:
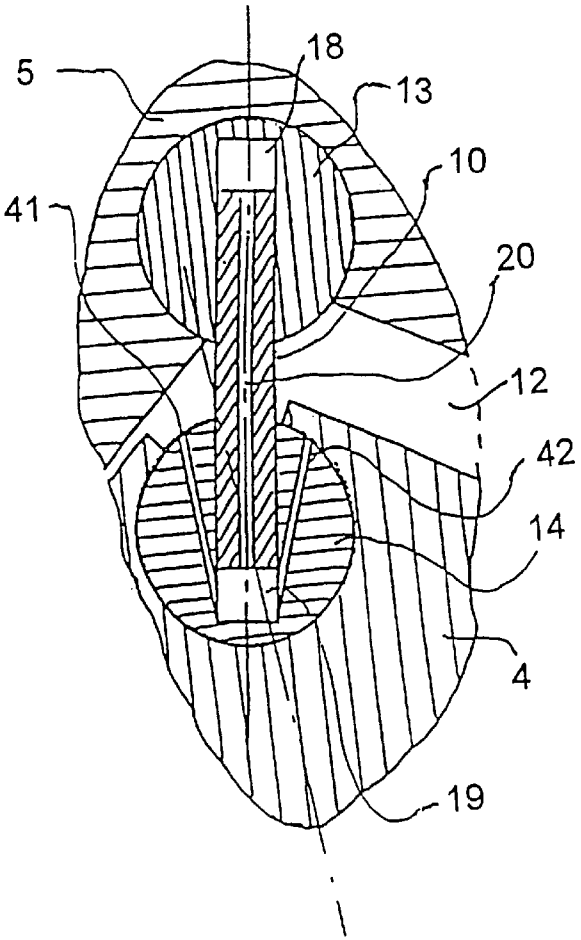
Figure 15B:
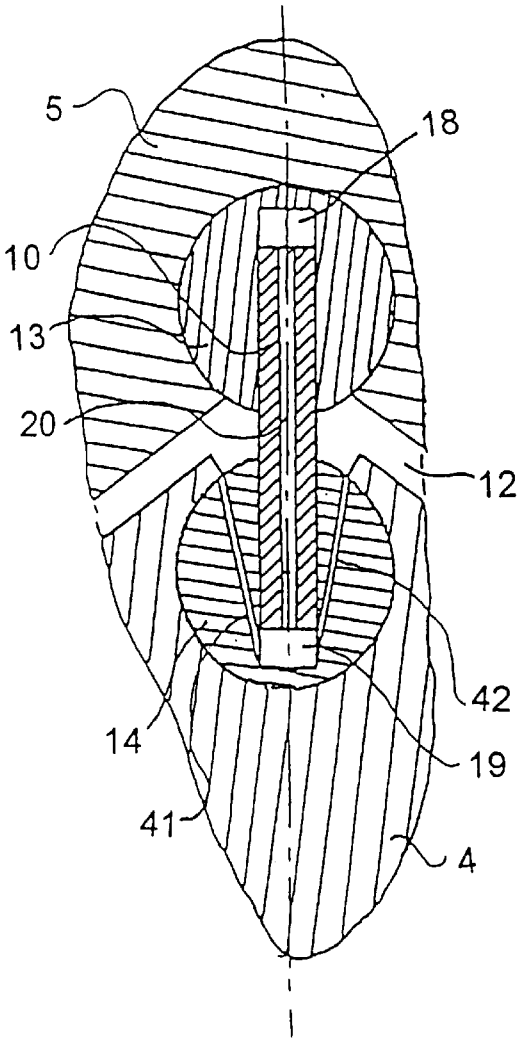
Figure 18:
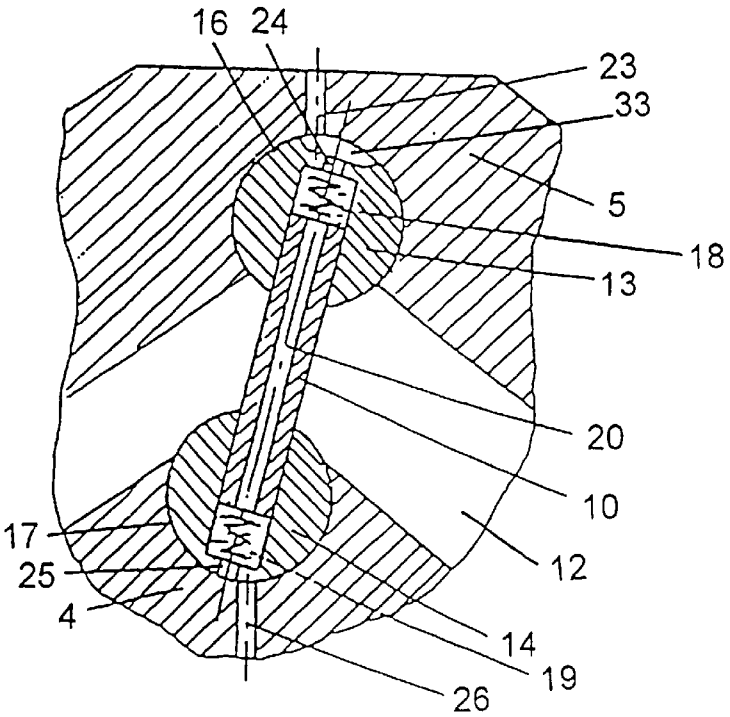
FIG. 18 illustrates a vane inserted in its slots of its two pivot bodies, whereby the dampening of the reciprocating movement is achieved by spring members and fluid dampening means.

FIGS. 15*a*–15*c* illustrate various positions of the gas channels 41, 42 during operation of the engine. At the position according to FIG. 15 a channel 42 produces a communication between the corresponding combustion chamber 12 and the slot 19 allowing a gas flow thereto and to the end of the vane 10.

In FIG. 15*b* the piston member 4 has continued its orbital movement and has moved closer to the housing member 5. Both gas channels 41, 42 are blocked so that a gas cushion is present in the slots 18, 19 which dampens the movement of the vane 10.

In FIG. 15*c* the piston member 4 is moving way from the housing member 5. Now gas channel 41 communicates with the respective combustion chamber such that the gas pressure in the slots 18, 19 is relieved.

It must be mentioned that the diameters of the gas channels 41, 42 and also of the channels 20 are selected in such a manner that they cause a throttling of the pressure of the gas.

Figure 16:
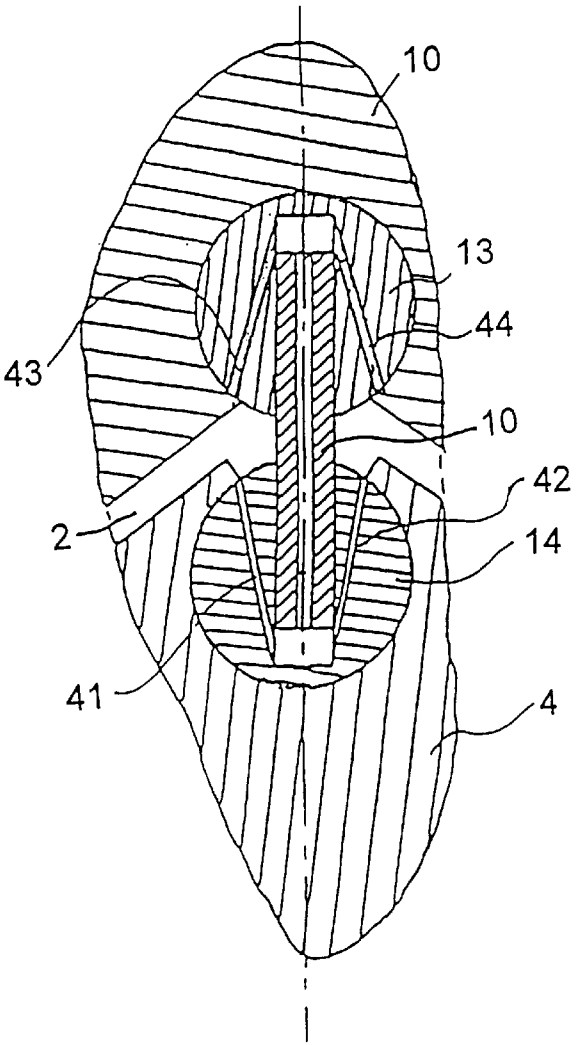
FIG. 16 illustrates a second embodiment regarding the location of the gas channels.

FIG. 16 illustrates an alternative embodiment, according to which both pivot bodies 13, 14 include gas channels. That is, each second pivot body 14 includes as above gas channels 41, 42, but pivot body 8 includes additionally gas channels 43, 44.

It is to be noted generally that the described arrangements are selected generally in such a manner that the vanes 10 are supported in the middle position relative to the centres of rotation of the pivot bodies 13 and 14. In other words, the vanes 10 should move in operation to and fro at minimal distances, leading to the best characteristics of the dynamic motion of the vanes 10. This can be achieved e.g. by a precise selection of the stiffness of the springs 21 and 22 (FIG. 2) or in case of a dampening of the motion of the vanes 10 by gas pressure, by a precise selection of the throttling of the gas flow, basically by a corresponding selection of diameters of gas channels.

As shown, there are three embodiments regarding the location of the gas channels 41, 42 and 43, 44, respectively.

According to the embodiment of FIGS. 15*a*–15*c* the gas channels 41, 42 are located exclusively in the second pivot bodies 14 which are received in the piston member 4. In this embodiment, a respective gas channel (FIG. 15*c*, channel 41) is open, i.e. causes a communication between a respective combustion chamber and the slot 19 in the pivot body 14 at the time of the ignition, i.e. firing of the air-fuel mixture. This situation demands a forced closing of the respective channel, e.g. by sing a double-action valve which provides a certain range of the value of the gas pressure in the vane stabilizing system. This arrangement will be explained more in detail further below.

Figure 17:
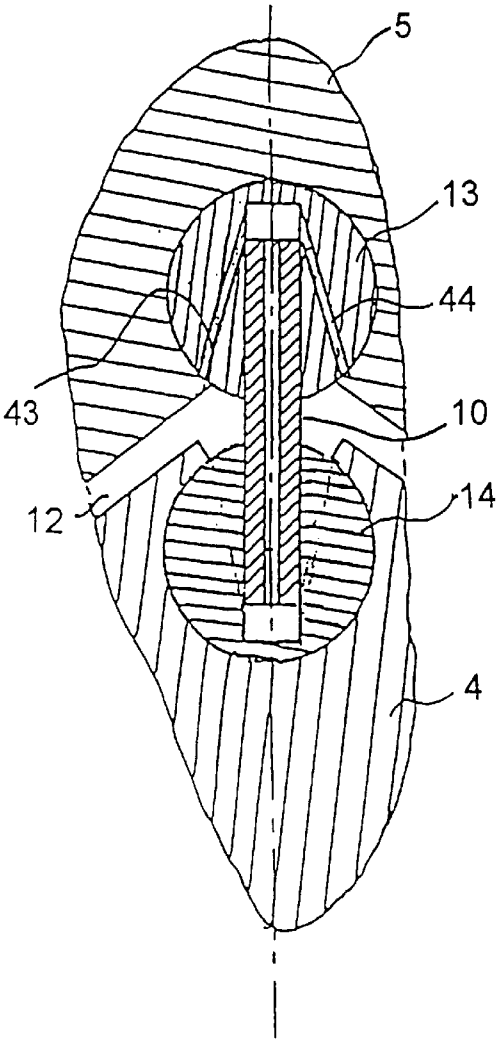
FIG. 17 illustrates a third embodiment regarding the location of the gas channels.

FIG. 17 illustrates an embodiment according to which the gas channels 43, 44 are located exclusively in the first pivot bodies 13 which are received in the housing member 5. In this embodiment the gas channels 43, 44 are covered by the housing member 5 at the time of the ignition, i.e. firing of the air-fuel mixture, thus no further pressure controlling measures are needed.

The lubrication circuit of the engine will now be described with reference to FIGS. 18, 19, 20*a*, 20*b* and 21.

At each location corresponding to the location of a first pivot body 13 a through bore 23 is performed through the housing member 5. All these through bores are adapted at the outer side of the housing member 5 to be coupled to corresponding lines of the lubrication medium system outside of the housing member (Lube oil tank, etc.). Each pivot body 13, 14 includes a transition channel 24 or 25, respectively, extending from the slot 18 and 19, resp. to its periphery. The piston member 4 includes through bores 26 extending from its recesses 17 towards the bearing 3.

Figure 19:
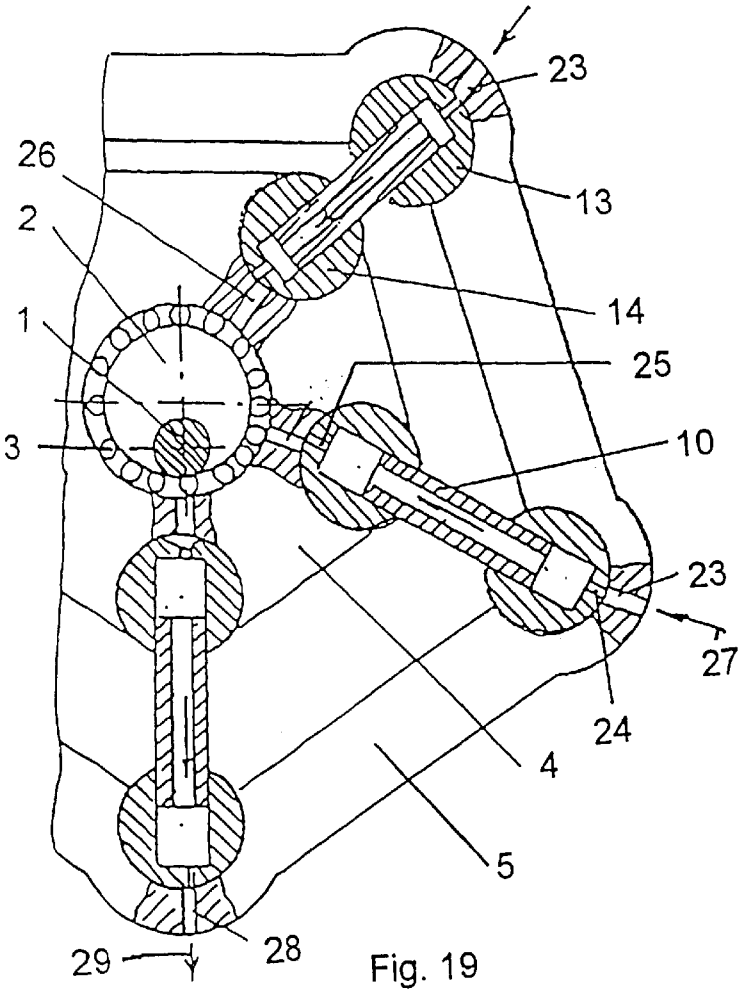
FIG. 19 is a partial view of a section through the combustion engine for a schematical illustration of the lubrication.

A number of the through bores 23 of the housing member 5 will be coupled to a lubrication medium inflow line, the inflowing lubricant being identified in FIG. 19 by the arrow 27, and at least one through bore, which is identified by the reference number 28, will be coupled to a lubrication medium outflow line of the overall engine lubrication system, identified by the arrow 29.

Figure 20B:
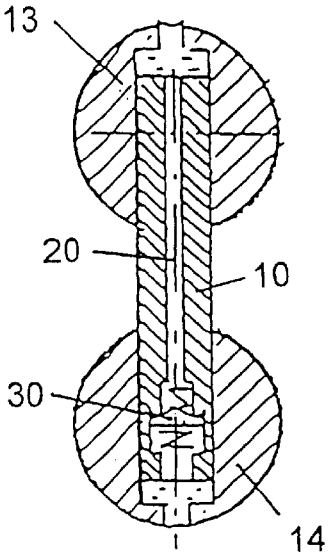
FIGS. 20*a, b* illustrate in a schematical manner the design of the vanes acting as pumps of the lubricant.
Figure 21:
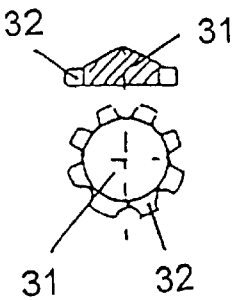
FIG. 21 illustrates a side view an a top view of a one-way valve shown in FIG. 24.
Figure 20A:
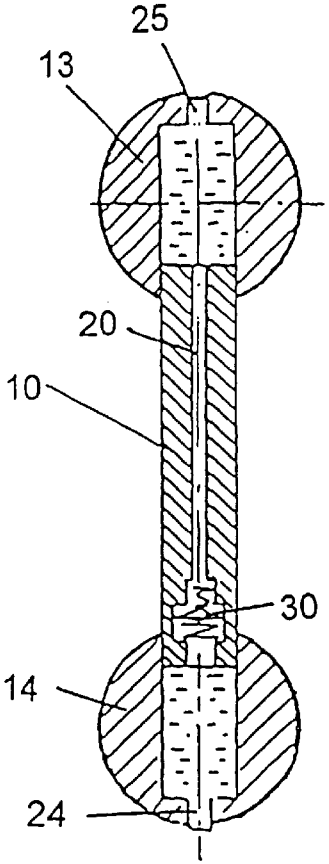

The vanes 10, through which the inflow of the lubrication medium occurs, are provided with one-way valves 30 having a valve body 31 and guiding ribs 32, see FIGS. 20*a*, 20*b* and 21.

These valves 30 are arranged in such a manner that they allow a flow only in the direction from the housing member 5 towards the piston member 4. Accordingly, these vanes 10 having the valves 30 operate as lubricant medium pumps.

At least one of the vanes 10, e.g. in FIG. 19 the lowermost vane has no such valve, wherewith a free lubricant medium outflow from the area of the bearing 3 back to the outside lubricant medium system is ensured.

The diameter of the through bore 26 in the piston member 4 corresponds to the diameter of the transition channel 25 in the pivot body 14.

Therefore, a flow communication between the through bores 26 and the transition channels 25 is established only in one rotational position of the pivot body 14 relative to the piston member 4.

The transition channels 24 in the pivot bodies 13 of the housing member 5 have at the embodiment illustrated in FIG. 3 a concave portion 33 opposite the through bore 23 in the housing member 5.

Therefore, a flow communication between the through bore 23 and the transition channel 24 is established only within a predetermined sector of the rotational movement range of the pivot bodies 8 relative to the housing member 5.

If now the rotational positions of the pivot bodies 13, 14 are such that no lubricant flow is possible, an amount of the lubricant is captured in the respective slots 18, 19 of the pivot bodies 13, 14. Thus, this captured amount of lubricant acts also as vane movement attenuating medium dampening the reciprocating movements of the vanes 10 in their respective end positions.

Figure 22:
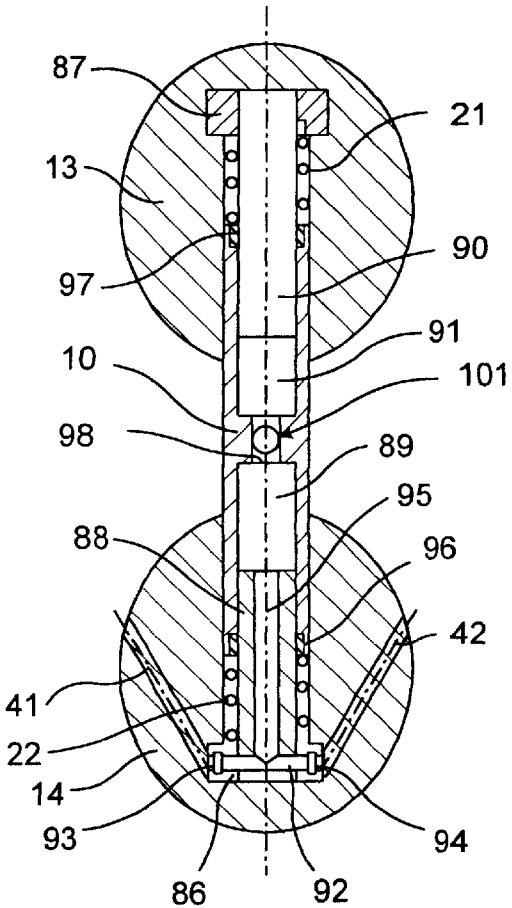
FIG. 22 illustrates in detail a section through a vane of a preferred embodiment perpendicularly to the pivot bodies.

FIG. 22 illustrates in detail a section through a vane 10 of a preferred embodiment perpendicularly to the pivot bodies 13, 14, whereby gas pressure is used to center the vanes 10 and to dampen their movement in order to prevent an impacting of the vanes 10 on the bottom of the slots of the pivot bodies.

One end of the vane 10 is located in the first pivot body 13 which is supported in the housing member, as described above. The opposite end of the vane 9 is located in the second pivot body 14 which is supported in the piston member, also as described above.

The second pivot body 14 comprises the gas channels 41, 42 which allow in certain positions of the second pivot body 14 a communication between the respective combustion chambers and the slot 19 in the pivot body. Reference numeral 86 designates an insert arranged in the second pivot body 14 and reference numeral 87 designates an insert arranged in the first pivot body 13. A rod 88 is mounted in the insert 86 and projects freely into a cylindrical cavity 89 in the vane 10. A further rod 90 is mounted to the insert 87 and projects freely into a further cylindrical cavity 91 in the vane 10.

The insert 86 comprises a lateral channel 92. Valves 93 and 94 are located in the lateral channel 92. A channel 95 of the rod 88 provides for a communication between the channel 92 of the insert 86 (and thus the channels 41, 42) and the cylindrical cavity 89 in the vane 10. The rod 88 is sealed against the inner circumference of the vane 10 by an annular seal 96. The rod 90 is sealed against the inner circumference of the vane 10 by a further annular seal 97.

The channels 89 and 91 are interconnected by a connecting channel 98. The reference numerals 21, 22 denote the earlier mentioned springs which prevent the vane from impacting the bottoms of the slots in the pivot bodies.

Figure 23:
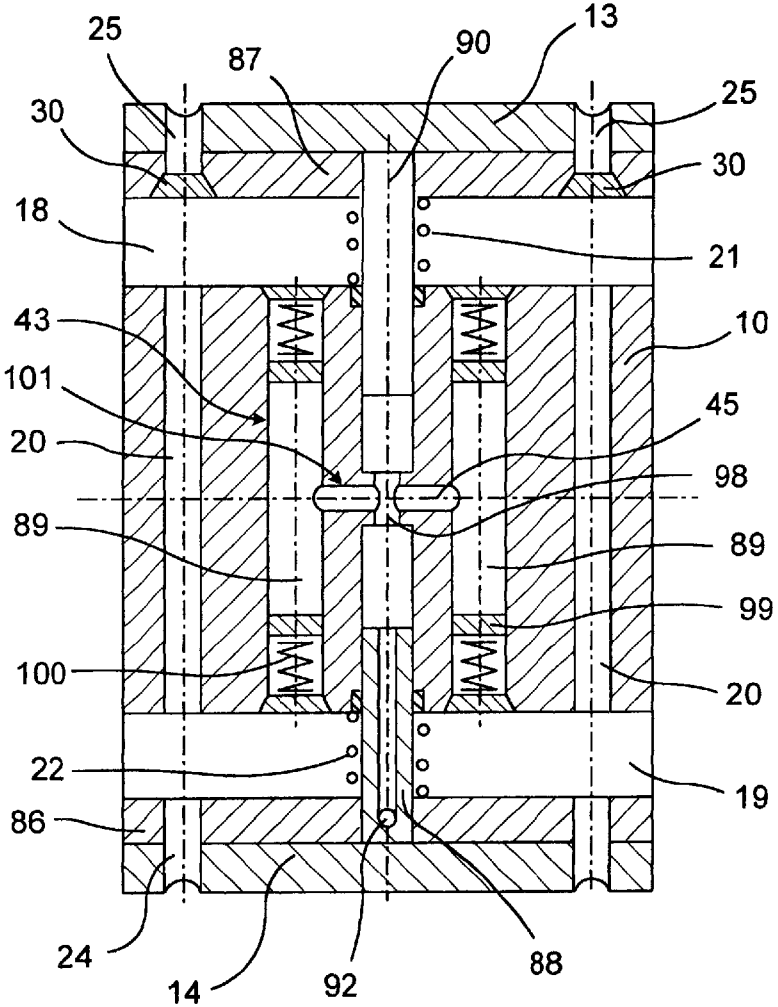
FIG. 23 illustrates in detail a section through a vane of a preferred embodiment parallel to the axes of rotation of the pivot bodies.

Attention is now drawn to FIG. 23. Basically, it shall be understood that the vane 10 in FIG. 23 moves vertically in this illustration.

As can be seen, the vane 10 includes in this embodiment two parallel cavities 43 in which totally four plungers 99 are received. These plungers 99 are spring loaded by springs 100.

A channel 101 interconnects the cavities 89 with the connecting channel 98.

These channels and their interconnections, as described with reference to FIGS. 22 and 23, and also the illustrated springs control the movements of the vanes 10, such as basically explained earlier.

As illustrated in FIG. 23, the vanes 10 include, furthermore, through channels 20 for the lubricant, see also FIGS. 19 and 20*a, b*. As can be seen, these channels 20 extend parallel to the channels 89. The first pivot body 13 includes the lubricant channels 25 and the second pivot body 14 includes the lubricant channels 24, whereby attention is drawn again to FIGS. 19 and 20*a, b*. Each channel 25 includes the one way valve 30.

The slots 21 are also illustrated in FIG. 23. Thus, it can be seen that during operation there is a pumping action due to the movement of the vane 10 and the valves 30 in that during the downwards movement (based on the illustration of FIG. 27) of the vane 10 lubricant can flow due to the lifting-off movement at the valves 30 and that during the upwards movement of the vane 10 the valves 30 close. Accordingly, and such as explained earlier, the lubricant will be pumped from the housing member 10 to the eccentric portion 2 and accordingly to the bearing 3 and all other parts of the motor which are lubricated.

Figure 24:
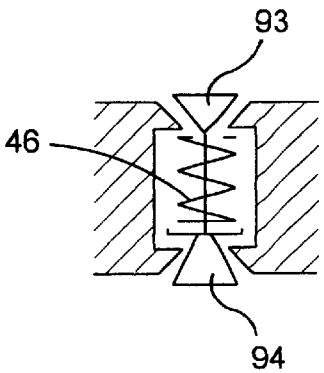
FIG. 24 illustrates, on an enlarged scale, a valve structure for the gas channels.

FIG. 24, finally, illustrates on an enlarged scale the arrangement of the valves 93 and 94, as shown in FIG. 22. The valves 93 and 94 are biassed by a spring 46 in a center position and move into their open and closed position in dependence from the gas pressure prevailing in the combustion chambers 11.

The operating process of the described internal combustion engine having an orbiting piston member 4 is based on the fact that the gas pressure produced by the combustion in the subsequent combustion chambers 11 acts onto the surfaces of the eccentrically supported piston member 4 which, in turn, causes the drive shaft 1 to rotate.

The generation of the circular parallel motion of the piston member 4 around the drive shaft 1 leads to the best dynamic characteristics of an internal combustion engine and produces optimal conditions in the combustion chambers 12 for the process of converting the energy produced by the combustion of the fuel/air mixture into mechanical energy at the drive shaft 1. This is achieved by a circular motion of the piston member 4 around the drive shaft 1, (that is an orbiting motion of the piston member 4), of at least two points of the piston member 4, which is achieved in that the piston member 4 is eccentrically supported on the drive shaft 1, and in that the pivot bodies 14 carried in the piston member 4 are supported at the same eccentricity as the piston member 4 in the circular plates 61, 72 supported in turn in the two end caps 6 and 7. This arrangement allows a selection of smallest possible dimensions of the combustion engine.

The transmission of the forces and the motion of the piston member proceed as follows:

The combustion gas pressure acts onto the piston member 4 forcing it to move. The piston member 4 transfers its motion to the drive shaft 1 because the force acting via the piston member 4 onto the eccentric portion 2 creates a force directed through the center of the eccentric portion 2 which accordingly creates a revolving movement of the eccentric portion 2 relative to the center axis of the drive shaft 1, thus causing the drive shaft 1 to rotate.

The piston member 4 will, furthermore, cause a force to act onto its pivot bodies 14, wherewith the vanes 10 are forced to move and the first pivot bodies 13 of the housing member 5 are forced to pivot. The force which acts onto the (second) pivot bodies 14 of the piston member 4 are also directed against their center axes and conclusively produce a movement relative to the axis of rotation of the circular plates 61, 72, such that the circular plates 61, 72 are forced to rotate. The eccentricities of the eccentric portion 2 and of the pivot bodies 14 in the circular plates 61, 72, which eccentricities are of the same magnitude, determine the path of the movement of the piston member 4 and ensure the circular parallel, i.e. orbiting motion of all parts in question around the drive shaft 1.

While there are shown and described presently preferred embodiments of the invention, it is to be distinctly understood that the invention is not limited thereto but may be otherwise variously embodied and practised within the scope of the following claims.

What is claimed is:

1. An internal combustion engine including a piston member supported to perform an orbiting movement, said combustion engine having a housing member which is closed at opposite ends by end caps having a drive shaft extending through said housing member perpendicularly to the end caps; further having a piston member located inside said housing member and eccentrically supported on an eccentric portion of the drive shaft and guided to orbit without rotation when the combustion engine is in operation; further having a plurality of radially and equidistantly arranged vanes extending between said piston member and said housing member, which vanes are sealed against said end caps and define a plurality of combustion chambers located between said end caps, said housing member and said piston member;

comprising a plurality of first equidistant cylinder shaped pivot bodies, each received for rotation in a corresponding first recess formed in said housing member and having a slot extending in the direction of its generatrix, in which slot a first end section of a corresponding vane is received for a free reciprocating sliding movement therein;

and comprising a plurality of second equidistant cylinder shaped pivot bodies, each received for rotation in a corresponding second recess formed in said piston member and having a slot extending in the direction of its generatrix, in which slot a second end section of a corresponding vane is received for a free reciprocating sliding movement therein;

whereby in operation of the internal combustion engine each vane is free to perform reciprocating and pivoting movements to induce the orbital motion of the piston member relative to the housing member;

in which each slot of said first and second pivot bodies contains a damper spring member position between the end section of the vane received in the slot and a slot bottom area, which spring members are adapted to attenuate the longitudinal movements of said vanes.

* * * * *